US010932630B1

(12) United States Patent
Luu

(10) Patent No.: US 10,932,630 B1
(45) Date of Patent: Mar. 2, 2021

(54) SMART PORTABLE TOILET AND METHOD

(71) Applicant: Toan Van Luu, Ho Chi Minh (VN)

(72) Inventor: Toan Van Luu, Ho Chi Minh (VN)

(73) Assignee: Ton Duc Thang University, Ho Chi Minh (VN)

( * ) Notice: Subject to any disclaimer, the term of this patent is extended or adjusted under 35 U.S.C. 154(b) by 0 days.

(21) Appl. No.: 15/135,504

(22) Filed: Apr. 21, 2016

(51) Int. Cl.
*A47K 17/00* (2006.01)
*A47K 11/04* (2006.01)
*A47K 13/24* (2006.01)

(52) U.S. Cl.
CPC ..... *A47K 17/00* (2013.01); *A47K 11/04* (2013.01); *A47K 13/24* (2013.01)

(58) Field of Classification Search
CPC ..... A47K 11/035
USPC ..... 4/449–486; 422/1; 424/40; 510/109
See application file for complete search history.

(56) References Cited

U.S. PATENT DOCUMENTS 2,946,065 A * 7/1960 Smith ..... A47K 13/247 4/223
3,435,464 A * 4/1969 Harding ..... A47K 11/035 4/459
3,570,016 A * 3/1971 Ellis et al. ..... A47K 11/035 4/323
3,605,129 A * 9/1971 Inman et al. ..... A47K 11/035 4/238
3,835,480 A * 9/1974 Harding ..... E04H 1/1216 4/449
4,268,925 A * 5/1981 Marple ..... E03D 5/016 210/199
4,285,077 A * 8/1981 Braxton ..... A61B 10/007 4/144.1
4,305,164 A * 12/1981 Sargent ..... E04H 1/1216 4/459
4,380,836 A * 4/1983 Braxton ..... E04H 1/1216 4/449
4,493,118 A * 1/1985 Braxton ..... A47K 3/32 4/449
4,641,383 A * 2/1987 Sargent ..... E03D 5/01 137/587
4,712,255 A * 12/1987 Antos ..... E03D 5/012 222/533
4,974,265 A * 12/1990 Maggio ..... A47K 3/325 135/901
4,979,242 A * 12/1990 Maggio ..... E04H 1/1244 135/901
5,088,134 A * 2/1992 Douglas ..... A47K 13/247 4/459
5,682,622 A * 11/1997 Tagg ..... E04H 1/1216 4/449

(Continued)

*Primary Examiner* — Lori L Baker

(57) ABSTRACT

A smart portable toilet bowl includes a bottom tank releasably connected to a top tank, a hollow ball valve device configured to open when the toilet seat is open and close when the toilet seat is closed, and a controller configured to detect when a user starts to use the smart portable toilet, start a deodorizing fan to introduce antibacterial and deodorizing materials into the top segment and at the same time start an extractor fan to draw out odor, and when the user finishes using the toilet, activating a spray nozzle to clean the user for a first predetermined amount of time, dry up the user using drying fan for a second predetermined amount of time, and clean the toilet bowl using a flushing ring for a third predetermined amount of time.

20 Claims, 10 Drawing Sheets

(56) References Cited

U.S. PATENT DOCUMENTS 6,081,939 A * 7/2000 Dainelli ..... E03D 11/10
4/449

* cited by examiner

SMART PORTABLE TOILET AND METHOD

FIELD OF THE INVENTION

This is a patent related to a toilet bowl device. More particularly, this patent relates to a portable and intelligent toilet.

BACKGROUND ART

Toilet bowls are among the most important inventions that improve human hygiene. Modern toilet bowls are usually placed in a fixed location and have two ends: one end connected to a water source and the other end connected to a waste tank. Because of such fixation, patients in a hospital, especially post-surgery patients or patients with muscular or bone diseases such as muscular dystrophy or osteodystrophy will have tremendous difficulties going to such fixed toilet rooms. These types of patients must need assistance from loved ones or a team of nurses or medical assistants. Therefore, mobile toilet bowls were invented and used everywhere. In the market, mobile toilet bowls are either affixed to a wheelchair or to a patient bed to serve handicaps, osteodystrophy, and muscular dystrophy patients. In addition, portable and/or mobile toilet bowls are useful to outdoor people such as campers, tourists, and fishermen, etc.

Today there are many different portable toilets bowls available in the market. These apparatuses still use cleaned water and retain waste materials such as feces for a certain number of uses. Portable toilet bowls have two different storage tanks—a top tank and a bottom tank. Cleaned water is introduced into the top tank for storage and for later use. Cleaned water can be resupplied after many uses. Used water and waste materials are channeled to the bottom tank and stored there for one or more uses. The combination of used water and waste materials is dumped into other fixed toilet bowls or in designated public dumping areas.

However, some of the conventional portable toilets have limited usability because they affixed to a wheelchair or a bed. Other portable toilet bowls cannot be disassembled and they are cumbersome, especially when they are filled up with waste materials.

Yet in other conventional portable toilet bowls which can be disassembled, they do not have sufficient valves to safely contain feces and liquid waste materials. As a result, they tend to leak when they are moved around.

In addition, conventional portable toilet bowls do not have sufficient functions to meet user's demands and needs. Users such as campers and tourists still need comforts, even when they are outdoors. These conventional portable toilets bowls do not have automatic or fully controlled flushing rings to clean the toilet basin, spray nozzle to clean a user's posterior, and hot drying air after each water cleaning, etc.

Users such as patients with osteodystrophy and muscular dystrophy need a smart portable toilet. Conventional toilet bowls cannot provide automatic or pre-programmed functions to serve the needs of these types of users.

Therefore, there is a need for a simple, removable, safe and leak free, and intelligent to meet demands of different types of users such as patients, tourists, campers, and fishermen.

The portable smart toilet of the present invention meets the above requirements.

SUMMARY OF THE INVENTION

Accordingly, an object of the present invention is to provide a smart portable toilet bowl including a bottom tank releasably connected to a top tank, a hollow ball valve device operative to open when the toilet seat is open and close when the toilet seat is closed, and a controller operative to detecting when a user starts to use said smart portable toilet, starting a deodorizing fan to introduce antibacterial and deodorizing materials into the top segment and at the same time start an extractor fan to draw out odor, and when the user finishes using the toilet, activating a spray nozzle to clean the user for a first predetermined amount of time, drying up the user using drying fan for a second predetermined amount of time, and cleaning the toilet bowl using a flushing ring for a third predetermined amount of time.

Yet another object of the present invention is to provide a method of using a smart portable toilet including a bottom tank releasably connected to a top tank, a toilet seat, a cover connected to a hollow ball valve device, a flushing ring, a spray nozzle, a drying fan, a extractor fan, and a deodorizing fan; the method comprising the steps of: opening the toilet seat for use, rotating a hollow ball valve device to open a discharge conduit located in the top tank, beginning to use the toilet, start a deodorizing fan to introduce antibacterial and deodorizing materials into the top tank and at the same time start an extractor fan to extract odor, when a user finishes using the toilet, activating a spray nozzle to clean the user for a first predetermined amount of time, drying up user using drying fan for a second predetermined amount of time, and cleaning the toilet bowl using flushing ring for a third predetermined amount of time; and upon closing a toilet lid rotate the hollow ball valve device to close up the discharge conduit.

These and other advantages of the present invention will no doubt become obvious to those of ordinary skill in the art after having read the following detailed description of the preferred embodiments, which are illustrated in the various drawings and figures.

BRIEF DESCRIPTION OF THE DRAWINGS

The accompanying drawings, which are incorporated in and form a part of this specification, illustrate embodiments of the invention and, together with the description, serve to explain the principles of the invention.

FIG. 3A is a diagram illustrating the top view of the bottom tank in accordance with an exemplary embodiment of the present invention;

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
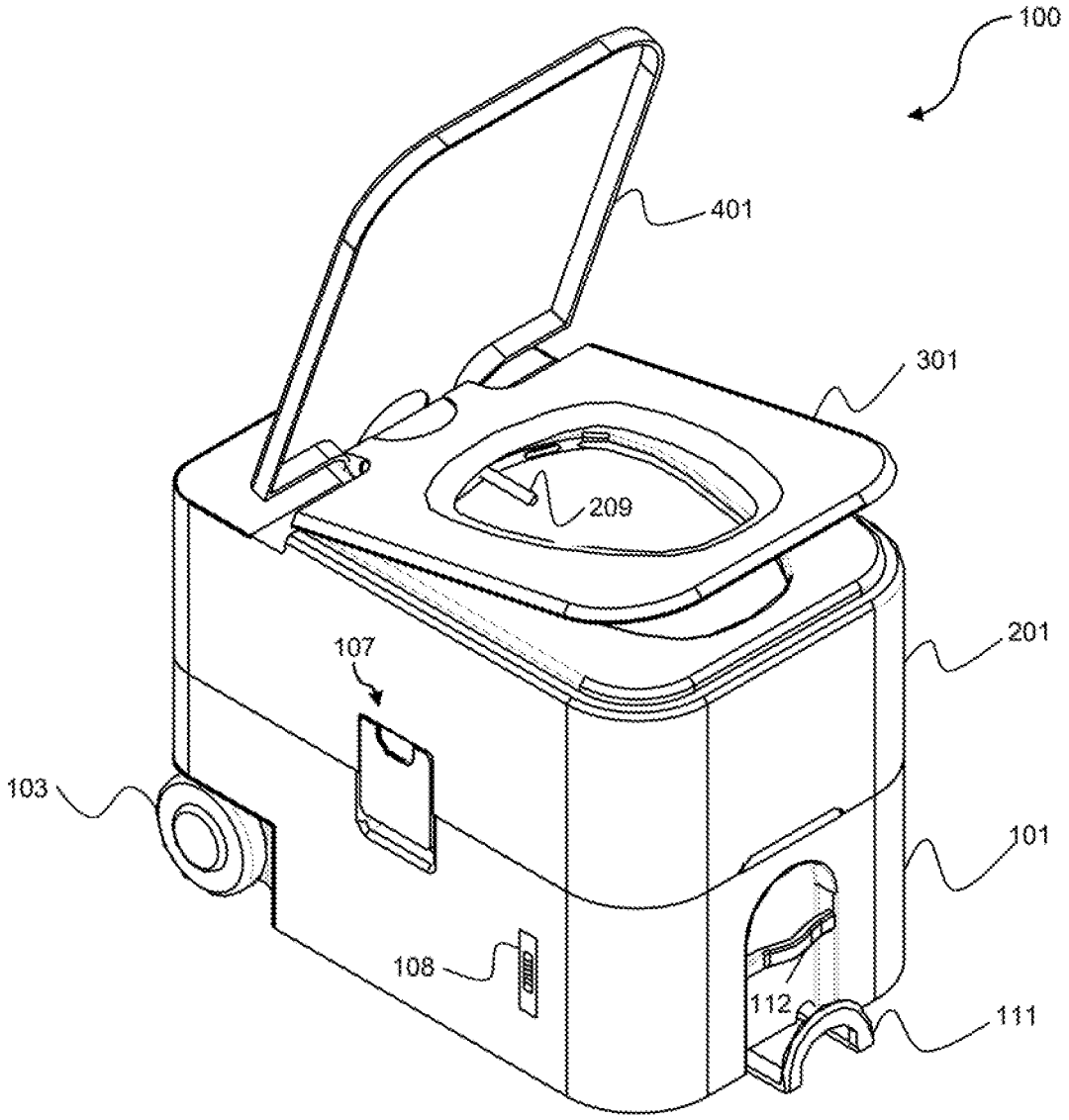
FIG. 1 is a diagram illustrating a perspective view of a portable smart toilet including a bottom tank and a top tank in accordance to an exemplary embodiment of the present invention.

Now referring to FIG. 1, a perspective view of a portable smart toilet 100 in accordance with an embodiment of the present invention is illustrated. In one preferred embodiment, portable smart toilet 100 includes a bottom tank 101, a top tank 201 releasably connected to bottom tank 101, a toilet seat 301, and a toilet lid 401. Both toilet seat 301 and toilet lid 401 are handedly connected to top tank 201. In a preferred embodiment, bottom tank 101 includes a first wheel 102 (not shown in FIG. 1) and a second wheel 103 on the back end. On top of the front end of bottom tank 101 there are a lift handle 112 and a retractable pull handle 111. On the right hand side of bottom tank 101, a waste level monitor 108 is designed to determine whether bottom tank 101 is full of waste materials and needs to be emptied. A first quick release locking mechanism 106 on the left hand side (not shown in FIG. 1) and a second quick release locking mechanism 107 on the right hand side of bottom tank 101 are used to releasably connect to top tank 201.

Continuing with the description of FIG. 1, top tank 201 includes a spray nozzle 209 protruding from the back end designed to clean a user after each use. With the embodiment described above, portable smart toilet 100 is portable and easy to assemble and disassemble for cleaning purposes. The detailed description of portable smart toilet 100 is described in the following figures.

Figure 2:
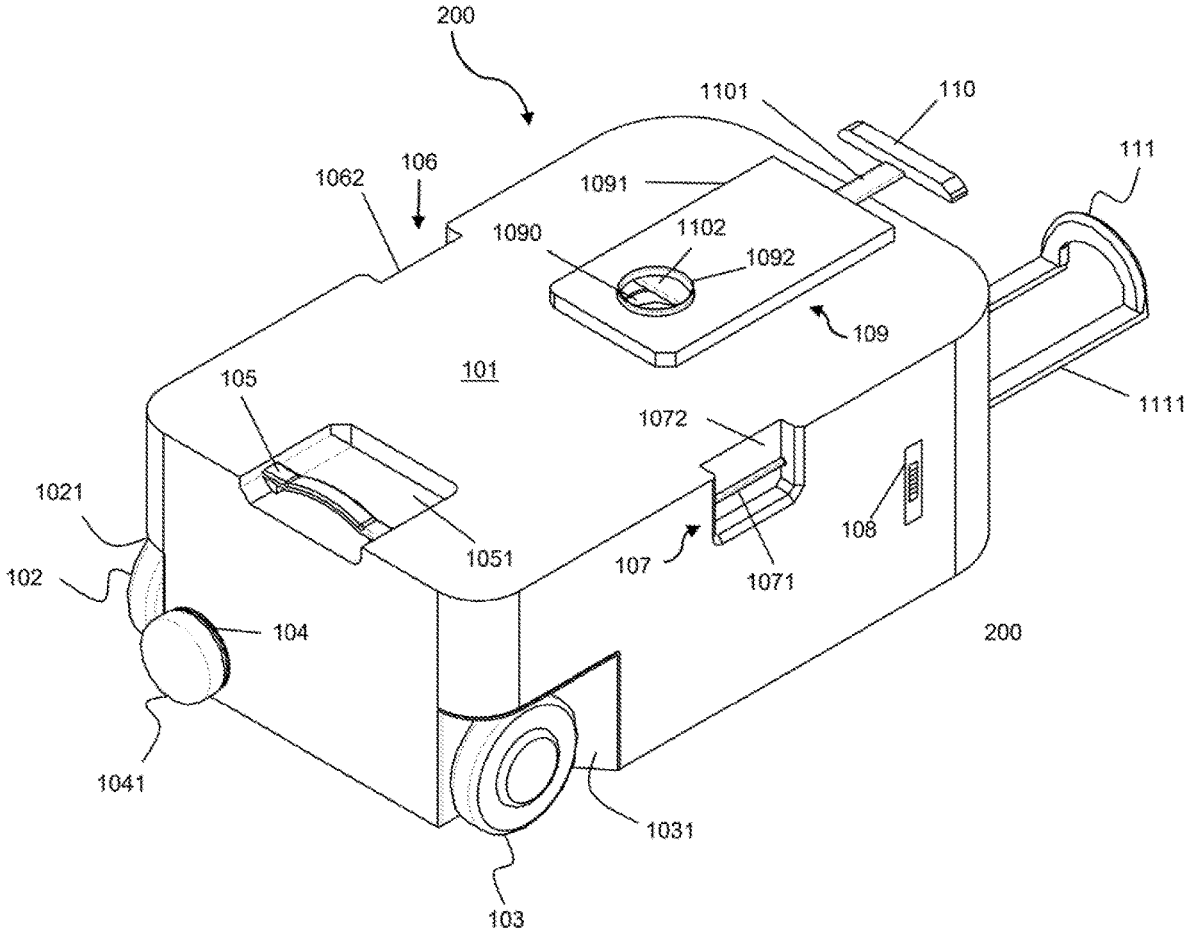
FIG. 2 is a perspective diagram of the bottom tank of the smart portable toilet of FIG. 1 in accordance with an exemplary embodiment of the present invention.

Next, referring to FIG. 2, a perspective diagram 200 of bottom tank 101 is illustrated. FIG. 2 describes bottom tank 101 in more details. In one embodiment, bottom tank 101 is a hollow container having a front side, a back side, left side, a right side, and a bottom side. Bottom tank 101 is a storage which contains waste water and waste materials (feces, etc.). On the back side, a circular evacuation opening 104 with an evacuation cap 1041 are located. Circular evacuation opening is used to empty the content of bottom tank 101 when it is filled up. On the right hand side, waste level monitor 108 is used to check the level of waste materials in bottom tank 101. On the left hand side, first wheel 102 is located inside a first wheel recess 1021. On the right hand side, second wheel 103 is located inside a second wheel recess 1031. On the top surface, a back lifting handle 105 is straddled across a back lifting recess 1051. Back lifting handle 105 is used to lift bottom tank 101 from the back side so that waste materials are retreating from evacuation opening 104. Additionally, a hole 1090 is cut out on the top surface of bottom tank 101 toward the front end so that waste materials and used water from top tank 201 are channeled through there. Also a sliding valve 109 is disposed over hole 1090 to close bottom tank 101 when not in use or when in motion. Sliding valve 109 further includes a rectangular cover 1091 having a circular opening 1092 which is aligned with hole 1090. Sliding valve 109 also has a handle 110 connected to a sliding door 1102 by a connecting bar 1101. When a user holds handle 110 and pulls outward, sliding door 1102 is slides in that direction, exposing hole 1090. On the other hand, when the user pushes handle 110 onward, sliding door 1102 is pushed in that same direction to cover up hole 1090.

Still referring to FIG. 2, on the left side and on the right side of bottom tank 101, first quick release locking mechanism 106 and second quick release locking mechanism 107 are located respectively. As shown in FIG. 2, second quick release locking mechanism 107 includes a second locking pin 1071 spanning across the second bottom lock recess 1072. Similarly, first quick release locking mechanism 106 includes a first locking pin 1061 (not shown in FIG. 2, please refer to FIG. 3A) spanning across first bottom lock recess 1062. The remaining components of the first quick release locking mechanism 106 and second quick release locking mechanism 107 will be shown and discussed in later figures.

Next, referring now to FIG. 3A, a top view 300A of bottom tank 101 discussed above in FIG. 2 is illustrated. In top view 300A, first bottom locking mechanism 106 is shown which include first locking pin 1061 and first bottom lock recess 1062. Other components of bottom tank 101 have already been discussed in FIG. 2 and need not repeat here.

Figure 3B:
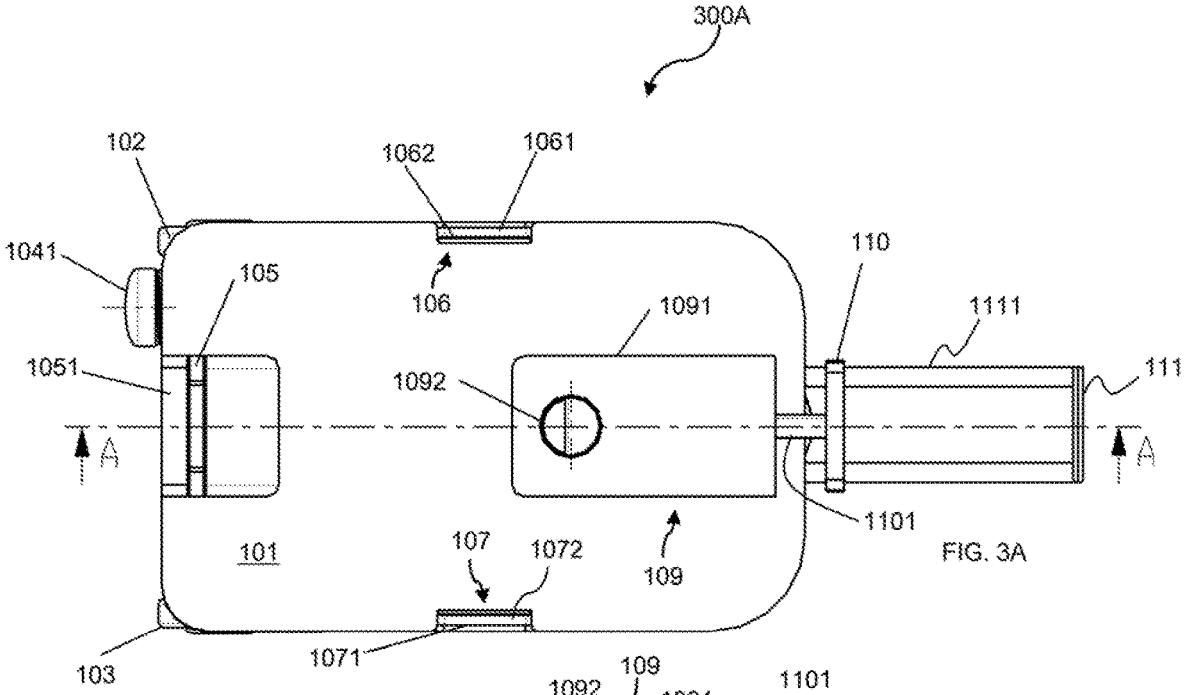
FIG. 3B is a diagram illustrating the cross sectional view across AA axis of the bottom tank in accordance with an exemplary embodiment of the present invention.
Figure 3B:
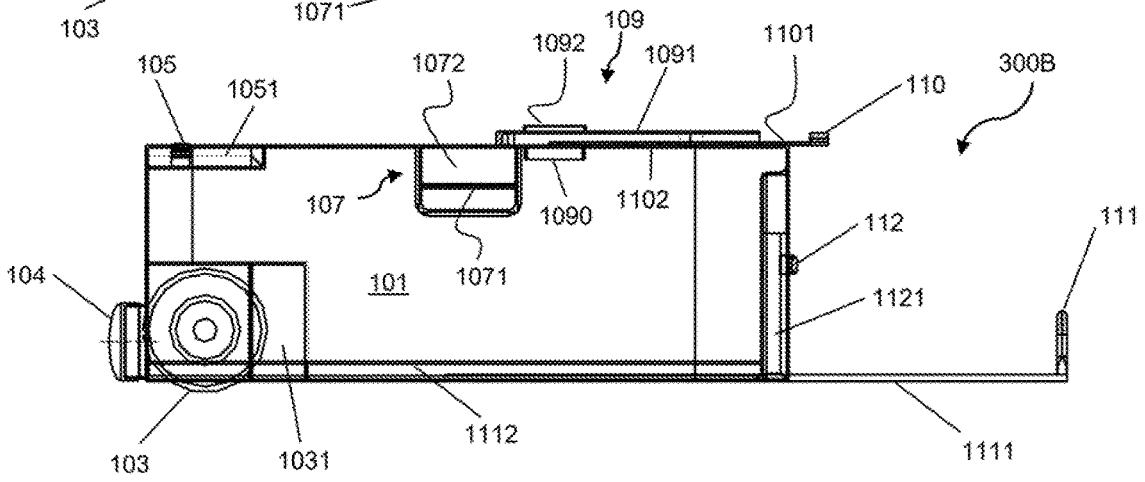

Next, referring to FIG. 3B, a lateral view 300B of bottom tank 101 viewed from the cross section along AA axis of FIG. 3A is illustrated. In cross sectional view 300B, bottom tank 101 is mainly a hollow container. Circular opening 1092 is aligned with hole 1090 so that waste materials and water are channeled into the hollow container of bottom tank 101. At the bottom, a telescopic arm tube 1112 is designed to store telescopic arms 1111 of retractable pull handle 111.

Figure 4:
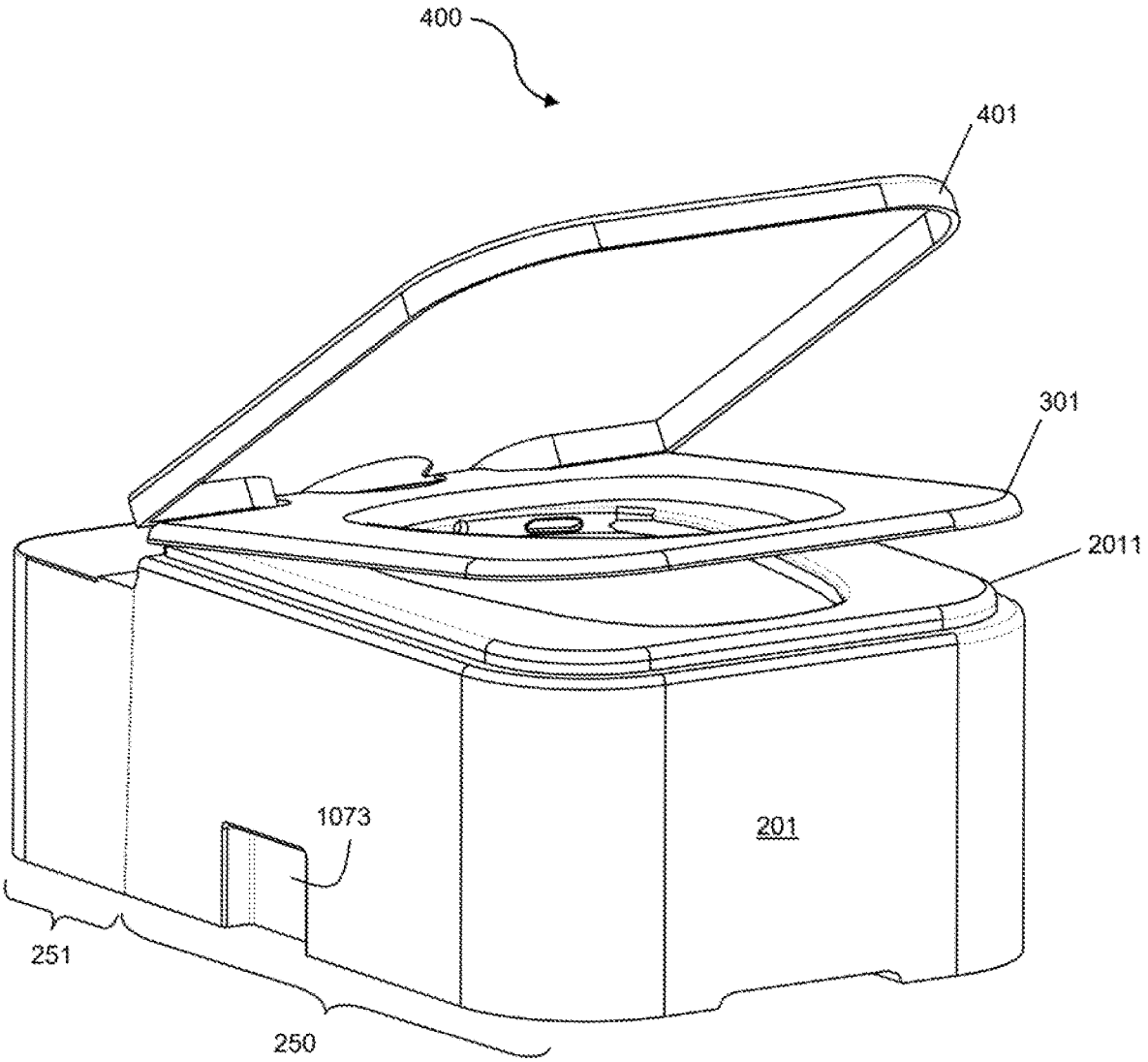
FIG. 4 is a perspective diagram of the top tank of the portable smart toilet of FIG. 1 in accordance with an exemplary embodiment of the present invention.

Now referring to FIG. 4, a perspective view 400 of top tank 201 described in FIG. 1 is illustrated. Top tank 201 is also rectangular in shape which includes a front compartment 250 and a back compartment 251. Front compartment 260 includes a front side, a top side, a bottom side, a back side, a left side, and a right side. On the top side, a toilet seat base (foundation) 2011 emerges vertically from front compartment 250. Toilet seat 301 and toilet lid (cover) 401 are hingedly connected on the back side of front compartment 260. At the bottom of the right side, a second top lock recess 1073 is disposed. Similarly, a first top lock recess 1063 (not shown) is disposed at the bottom of the left side of front compartment 250.

Figure 5A:
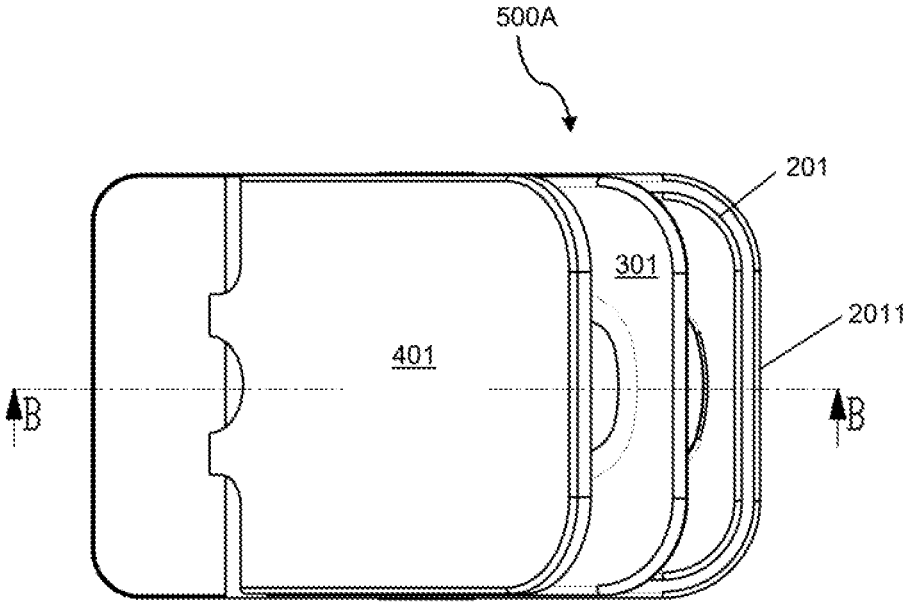
FIG. 5A is a top diagram of the top tank in accordance with an embodiment of the present invention.
Figure 5B:
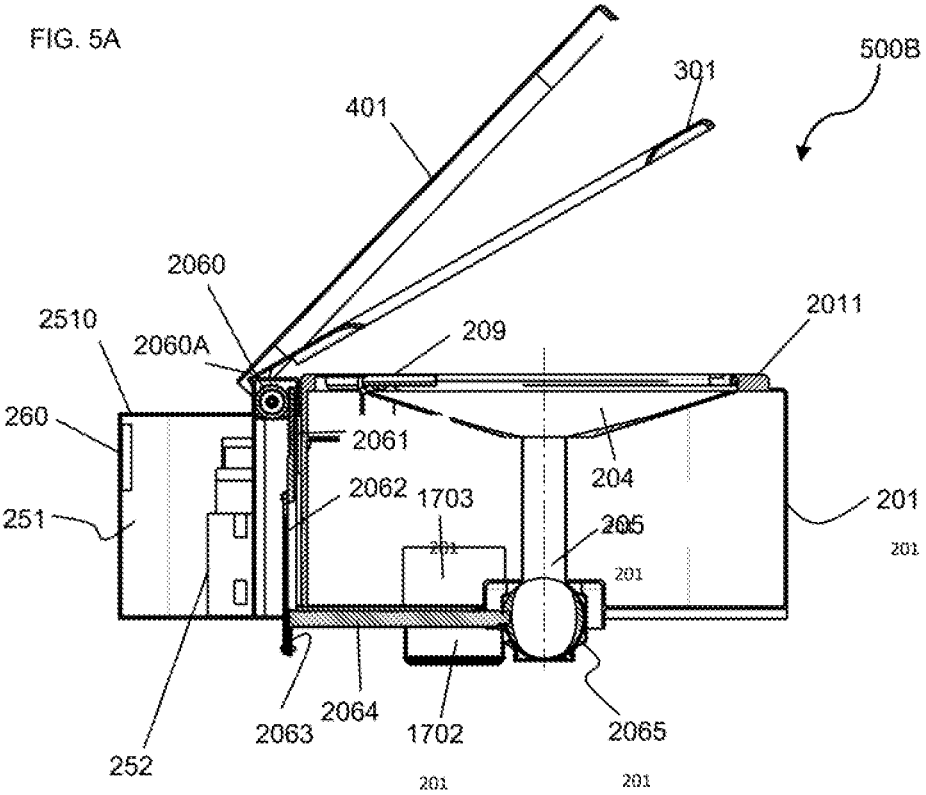
FIG. 5B is a cross sectional view across BB axis of the top tank in accordance with an exemplary embodiment of the present invention.

Next, referring to FIG. 5A and FIG. 58. FIG. 5A is a top view 500A while FIG. 5B is a cross sectional view 5008 along the axis BB of top tank 201. As described above in FIG. 4, front compartment 250 is a hollow container divided further into two segments. The first segment includes a funnel-shaped basin 204 connected to a discharge conduit 205 located at the center of front segment 250. First segment 260 is mainly a water storage surrounding funnel-shaped basin 204 and discharge conduit 205. In a preferred embodiment, toilet seat 301 and toilet lid 401 are hingedly connected to a spur gear 2060 meshed with a gear shaft 2061, a connecting arm 2062, a rotating arm 2063, an actuating arm 2064, and a hollow ball 2065. As seen, second top lock recess 1073 is aligned with the second bottom lock recess 1072. Other components of front compartment 250 will be described later in FIG. 9.

Now continuing with FIG. 5B, back compartment 251 is mainly a gear box and a control center of portable smart toilet 100 of FIG. 1. Back compartment 251 includes a controller 260 and other components such as a water pump 262. The detailed description of back compartment 251 is described later in FIG. 7 and FIG. 8.

Figure 6:
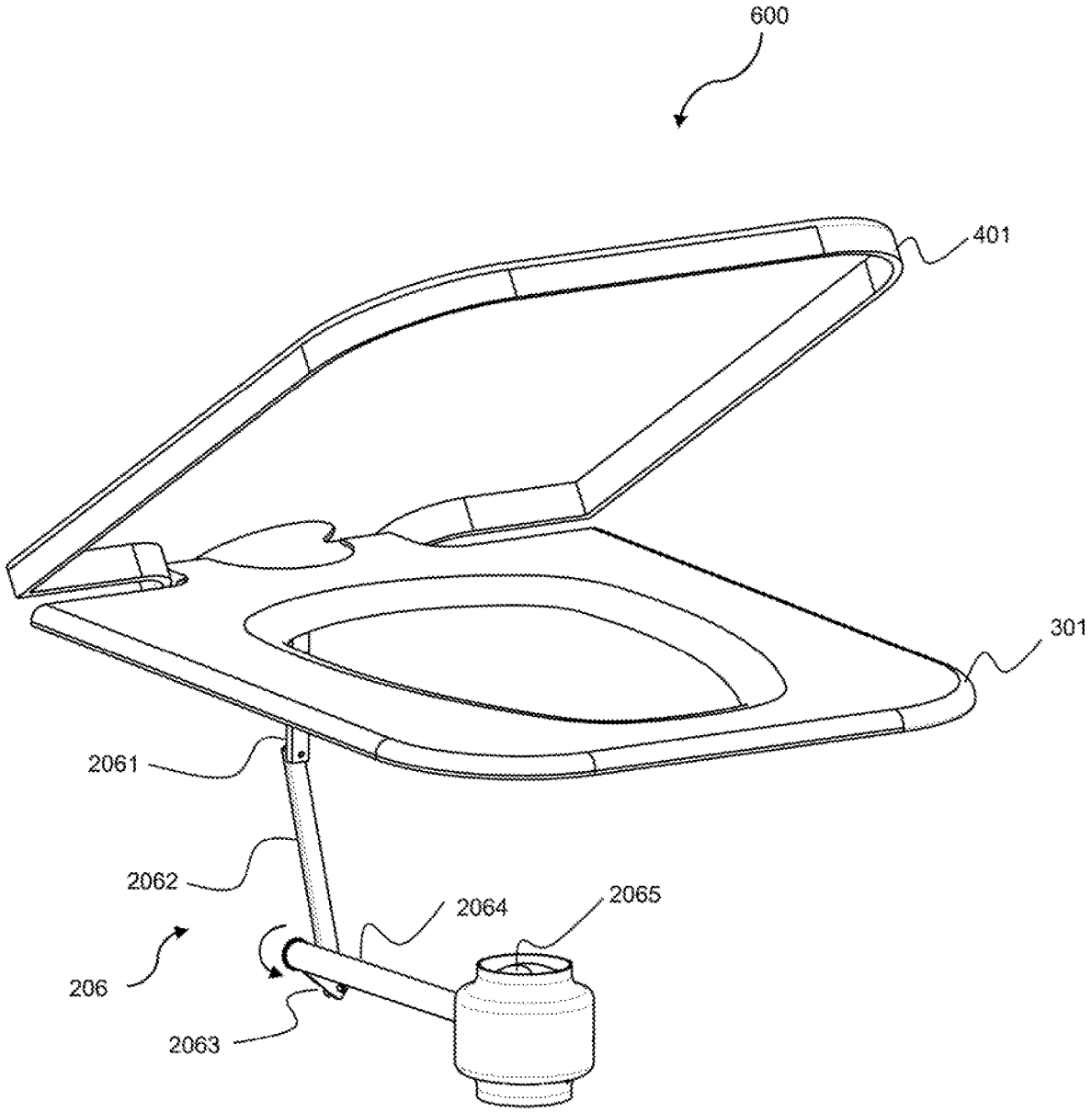
FIG. 6 is a diagram illustrating the perspective view of a hollow ball valve device in accordance with an exemplary embodiment of the present invention.

Referring to FIG. 6, a perspective view 600 of a hollow ball valve device 206 in accordance with an exemplary embodiment of the present invention is illustrated. Referring back to FIG. 58, hollow ball valve device 206 includes spur gear 2060 rotating around a gear axis 2060A (not shown), gear shaft 2061, connecting arm 2062, rotating arm 2063, actuating arm 2064, and hollow ball 2065, all connected together by joints and in communication with toilet seat 301 and toilet cover 401. Hollow ball 2065 includes a solid side and a hollow side. In operation, as a user lifts, toilet seat 301 and toilet lid 401 for use, spur gear 2060 is rotated counter-clockwise, lifting spur gears 2061. Connecting arm 2062 reciprocates by causing rotating arm 2063 to swing outward. As a result, actuating arm 2064 rotates and hollow ball 2065 to turn its hollow side upward lining up with discharge conduit 205. Thus, portable smart toilet 100 is ready to use. On the other hand, after the use, the user closes the toilet lid 401, spur gear 2060 is rotated clockwise, lowering spur gears 2061. Connecting arm 2062 reciprocates causing rotating arm 2063 to swing inward. As a result, actuating arm 2064 rotates and hollow ball 2065 to turn its solid side upward lining up with discharge conduit 205. In this situation, portable smart toilet 100 cannot be used.

Figure 7:
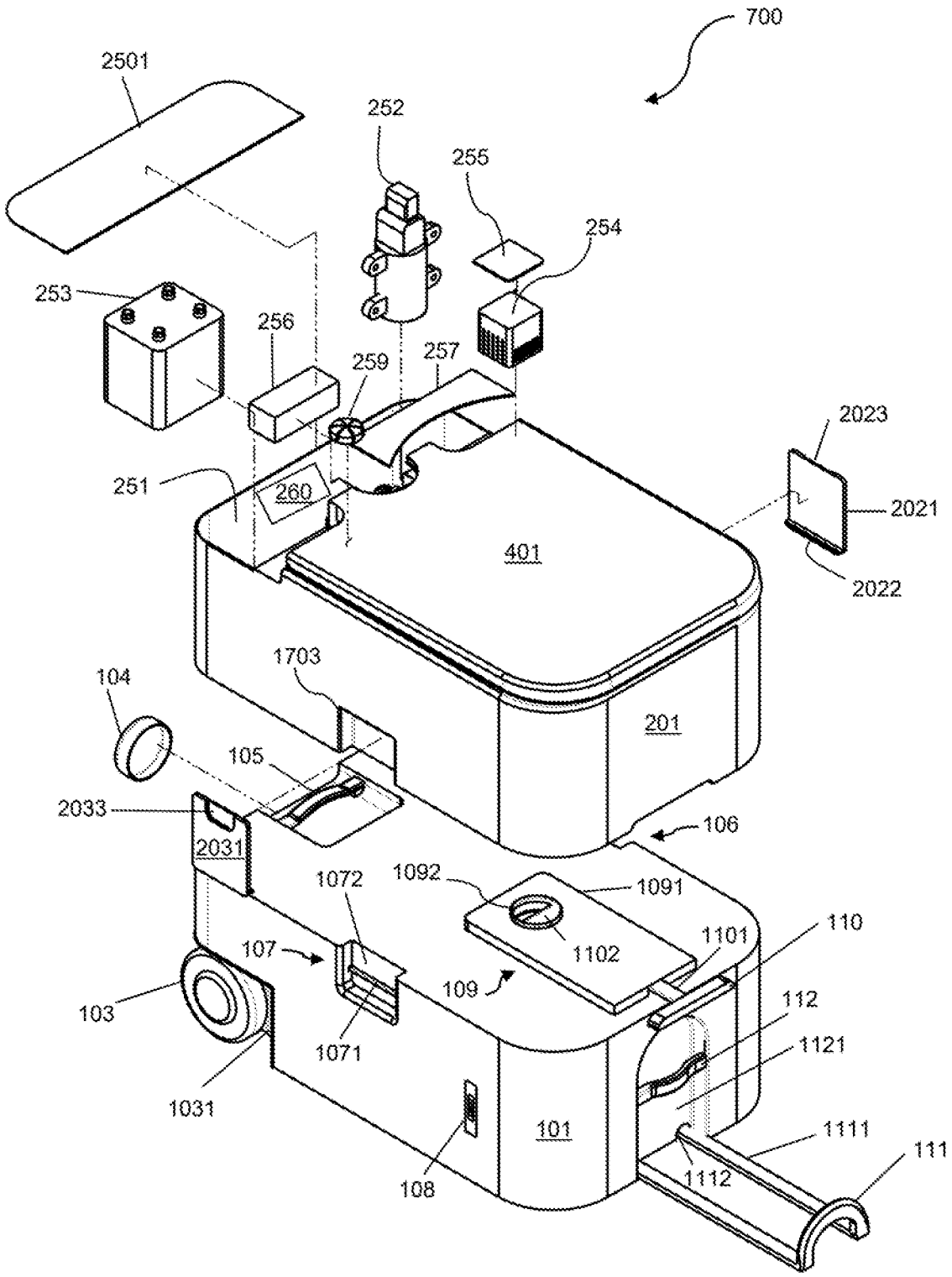
FIG. 7 is a diagram showing the components of the portable smart toilet of FIG. 1 and component in accordance with an exemplary embodiment of the present invention.

Now referring to FIG. 7, a top view 700 of top tank 201 in connection to bottom tank 101 and some components of back compartment 251 in accordance with an exemplary embodiment of the present invention. First quick release locking mechanism 106 further includes a first locking plate 2021 and second quick release locking mechanism 107 further includes a second locking plate 2031. As top tank 201 is placed on top of bottom tank 101, first top lock recess 1603 (not shown in FIG. 7) is aligned with first bottom lock recess 1602 (not shown in FIG. 7). Similarly, second top lock recess 1703 is aligned with the second bottom lock recess 1702. In one embodiment, a first locking plate 2021 and a second locking plate 2031 are used to releasably lock bottom tank 101 to top tank 201. First locking plate 2021 includes a first tap 2022 at the bottom and a first lock plate recess 2033 on the opposite side. As first bottom lock recess 1602 (not seen, please refer to FIG. 3A) is aligned with first top lock recess 1603 (not seen in FIG. 7, please refer back to FIG. 3A), first tab 2022 grasps first locking pin 1061 (not seen in FIG. 7, please refer back to FIG. 3A) and the top portion of first locking plate 2021 is snapped onto the first top lock recess 1603 (not seen in FIG. 7, please refer back to FIG. 3A). On the right hand side, as second bottom lock recess 1702 is aligned with second top lock recess 1703, a second tap 2032 grasps second locking pin 1071 and the top portion of second locking plate 2031 is snapped onto the second top lock recess 1703. To release, a user puts their fingers at first locking plate recess 2023 and second locking plate recess 2033 and pulls down. It is understood by a person of ordinary skill in the art that other quick release locking mechanisms can be used in the present invention.

Still referring to FIG. 7, in back compartment 251, a lid 2501 is used to cover all the components inside. In there, a deodorizing/anti-bacterial box 254, a water pump 252, a battery 253 are placed inside back compartment 251. A battery box 256 is used to contain and protect battery 253 from water in smart toilet 100. In a preferred embodiment, a controller 260 is electrically connected to control battery 253 and water pump 252, and deodorizing/anti-bacterial box 254. A lid 255 is used to cover deodorizing/anti-bacterial box 254. A complete description of all the components in back compartment 251 will be described in FIG. 8 and FIG. 9.

Figure 8:
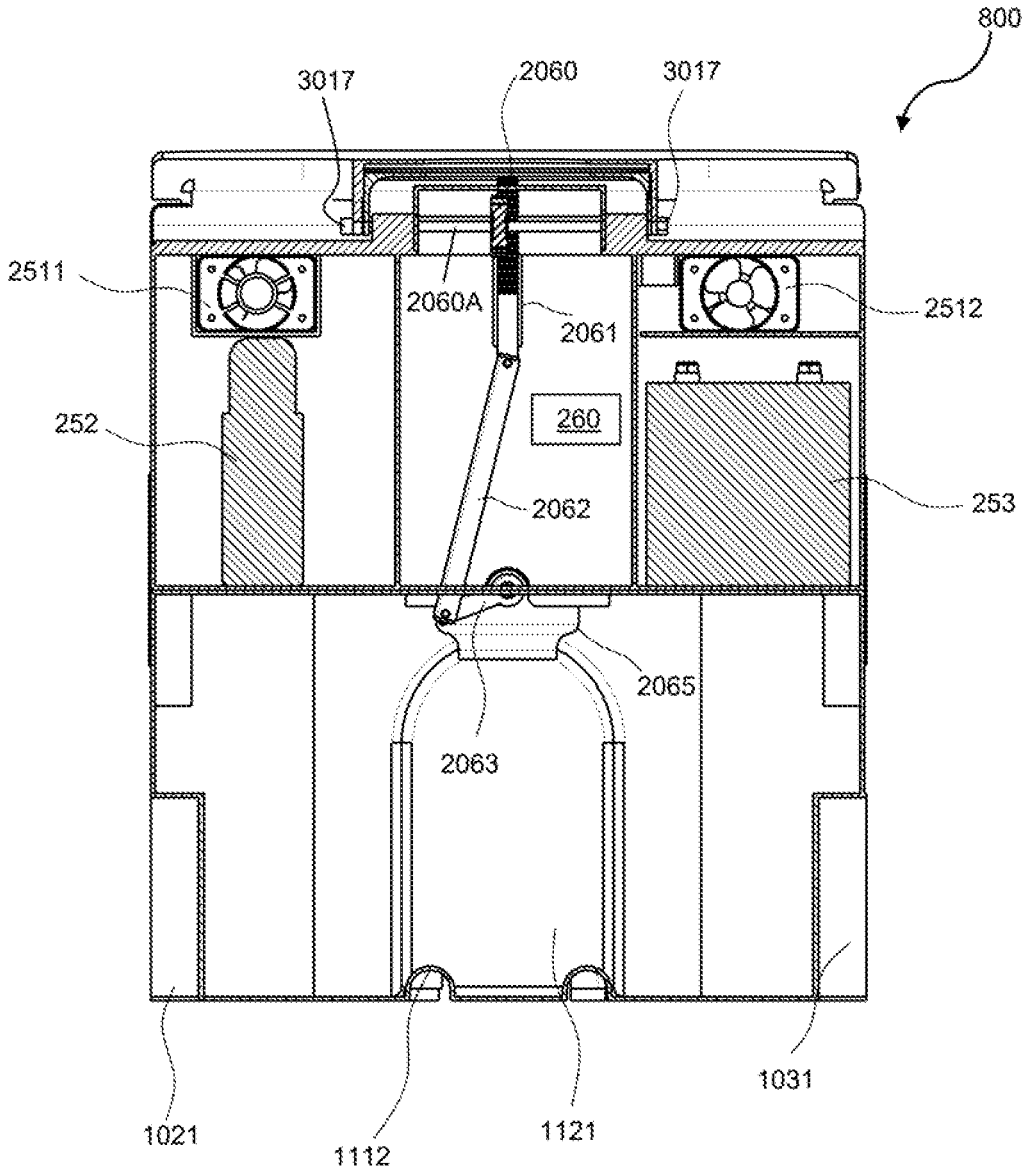
FIG. 8 is a diagram showing the rear view of the portable smart toilet of FIG. 1 in in accordance with an exemplary embodiment of the present invention.

Now referring to FIG. 8, a rear view 800 of back compartment 251 is illustrated. In perspective view 800, top tank 201 is locked onto bottom tank 101 by first locking plate 2021 and second locking plate 2031 being snapped onto respective first bottom lock recess 1062 aligned with first locking plate 1063, and second bottom lock recess 1072 aligned with second locking plate 1073. A deodorizing/anti-bacterial fan 2511 is placed next to deodorizing/anti-bacterial box 254 to inject both deodorizing and anti-bacterial materials into funnel-shaped basin 204 when portable smart toilet 100 is in use. During use, an extractor fan 2512 is turned on to draw bad odor out of a funnel-shaped basin 204. In one embodiment, the same extractor fan 2512 can be used to inject drying hot air after use by simply rotate extractor fan 2512 in an opposite direction. In another embodiment, a different hot air drying fan can be used. All of the fans are controlled by controller 260. A pair of gear axis hinges 3017 allow gear axis 2060A to rotate around itself.

Continuing with FIG. 8 and referring back to FIG. 6, in operation, as a user opens toilet lid 401, pair of gear axis hinges 3017 allow gear axis 2060A to rotate. As a result, spur gear 2060 is rotated counter-clockwise, lifting gears shaft 2061. Connecting arm 2062 reciprocates causing rotating arm 2063 to swing outward. Then, actuating arm 2064 rotates and hollow ball 2065 to turn its hollow side upward lining up with discharge conduit 205. Thus, portable smart toilet 100 is ready to use.

Figure 9:
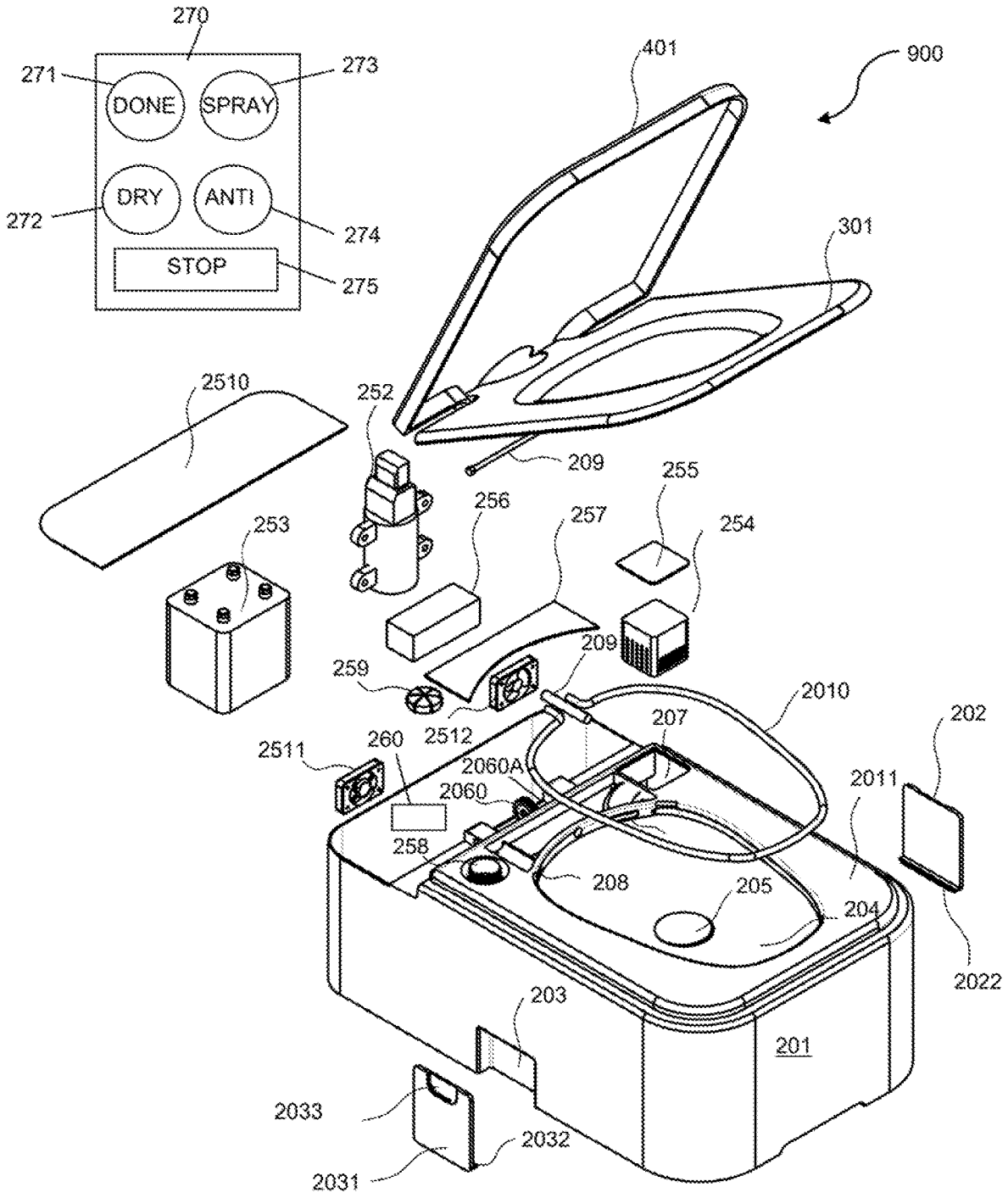
FIG. 9 is a diagram showing all the components of the top tank of the portable smart toilet and a remote control in in accordance with an exemplary embodiment of the present invention.

Referring to FIG. 9, a perspective view 900 of portable smart toilet 900 is illustrated which further includes a remote control 270 in communication with controller 260. All other components have been described in details in previous FIG. 1-FIG. 8 and therefore are not repeated here again. In one embodiment, remote control 270 includes a "done" button 271, a "dry" button 272, a"spray" button 273, an "anti" (in short for anti-bacteria) button 274, and a stop button 275. All of these buttons 271-275 are in communication with controller 260. "Done" button 271 is pressed by a user after use to start a cleaning cycle. During the cleaning cycle, the controller 260 causes spray nozzle 290 to spray water to clean the user for a first predetermined amount of time, extractor fan 2511 starts to blow drying hot air to dry the user for a second predetermined amount of time, and finally flushing ring 2010 to clean up funnel-shaped basin 204. In one embodiment of the present invention, first predetermined amount of time and second predetermined amount of time is set to 45 seconds, while the third predetermined amount of time is set to 30 seconds. Controller 260 controls the operations of spray nozzle 209, water pump 252, flushing ring 2010, deodorizing/anti-bacterial fan 2511, extractor fan 2512 in the automatic mode (in cooperation with a plurality of sensors).

Continuing with FIG. 9, in case the user wants to control portable smart toilet 100, he or she can presses stop button 275 to stop the cleaning cycle pre-programmed by controller 260. The user may press the spray button 273 to clean during use or to lengthen the cleaning time (greater than the preset first predetermined amount of time) when he or she feels that the cleaning is not complete. Similarly, dry button 272 is pressed when the user feels that the second predetermined time is not long enough. Anti (bacteria and odor) button 274 is pressed when the odor is too strong and third predetermined amount of time is not long enough. Finally, stop button 276 is pressed to stop all above buttons 271-274. In one embodiment, remote control 270 communicates wirelessly to controller 260. In another embodiment, remote control 270 is electrically connected to controller 260 via an electrical cord (not shown). Yet, in another embodiment, remote control 270 is a user's smartphone. An application dedicated to control portable smart toilet 100 as described above can be loaded into the users cell phone. After downloading such application on the smartphone, an icon appears on the screen. When the user presses to start that icon, buttons 271-275 appears on the display screen of the cell phone.

Figure 10:
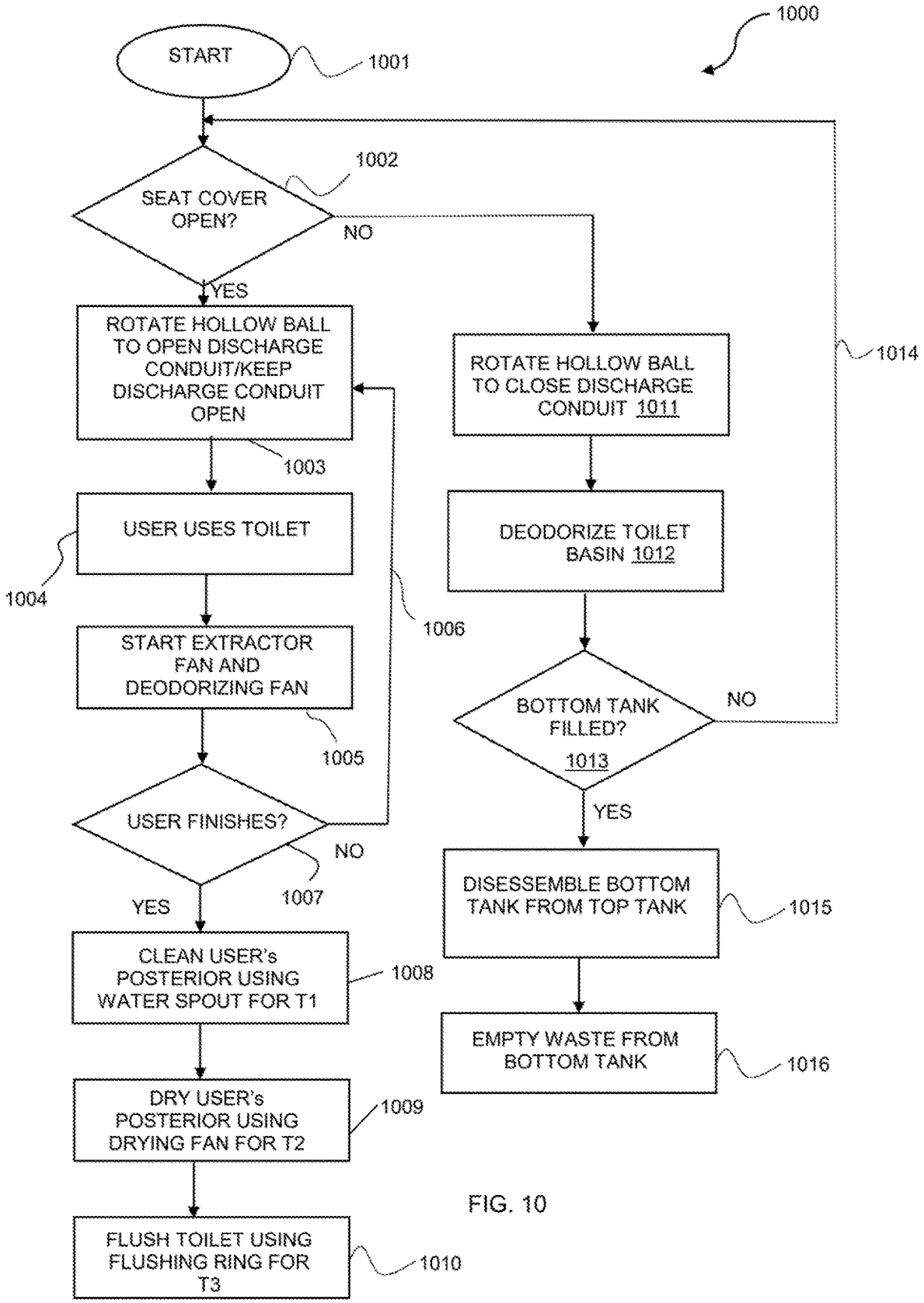
FIG. 10 is a flow chart illustrating a method of using a portable and a smart toilet in accordance with an exemplary embodiment of the present invention.

Finally, referring to FIG. 10, a flow chart illustrating a method 1000 of using a portable smart toilet. In one embodiment, method 1000 can be realized using portable smart toilet 100 described above. However, method 1000 of the present invention is not limited to the use of portable smart toilet 100. Any toilet device using the steps of method 1000 described herein is within the scope of the present invention. Method 1000 includes steps of opening a toilet seat for use, rotating said hollow ball valve device to open a discharge conduit located in a top tank, beginning to use the portable smart toilet, starting a deodorizing fan to introduce antibacterial and deodorizing materials into the top tank and at the same time start an extractor fan to extract odor away from top tank, when the user finishes using the portable smart toilet, activating the spray nozzle to clean the user for a first predetermined amount of time, drying up user using a drying fan for a second predetermined amount of time, cleaning a toilet bowl using a flushing ring for a third predetermined amount of time, and upon closing a cover rotate the hollow ball valve device to close the discharge conduit.

At step 1001, a user begins to use a portable smart toilet. In one embodiment, the user may begin by assembling the portable smart toilet or by checking the water level, or finally by opening the toilet lid. In practice, portable smart toilet 100 can be used to realize step 1001. A user can begin using portable smart toilet 100 by assembling the bottom tank 101 and top tank 201 together using first quick release locking mechanism 160 and second quick release locking mechanism 170. In another situation, a user may check the water level in top tank 201 before use. Yet in another situation, a user may begin, simply by opening toilet lid 401.

At step 1002, determining whether a toilet lid is opened or closed. This step is important in the present invention because it determines whether a toilet such as portable smart toilet 100 is ready to use. This leads to the next step.

Next, at step 1003, rotating a hollow ball valve device so that its hollow [[face]] side is faced upward if the toilet lid is opened. In one embodiment, step 1003 is realized by toilet lid 401 connected to the hollow ball valve device 206 described above. As a user lifts, toilet seat 301 and toilet lid 401 for use, pair of gear axis hinges 3017 allows gear axis 2060A to rotate. As a result, spur gear 2060 is rotated counter-clockwise, lifting gears shaft 2061. Connecting arm 2062 reciprocates causing rotating arm 2063 to swing outward. As a result, actuating arm 2064 rotates and hollow ball 2065 to turn its hollow side upward lining up with discharge conduit 205. Thus, portable smart toilet 100 is ready to use.

At step 1004, a user uses a toilet after the toilet is opened up by a hollow ball valve device.

At step 1006, extractor fan and deodorizing/anti-bacterial fan start to operate as soon as a user starts using the toilet. Step 1005 is realized by deodorizing/anti-bacterial material box 254, fan 2511, and extractor fan 2512. The user may use remote control 270 as described in FIG. 9 to actualize step 1005. In another embodiment, a plurality of sensors (not shown) disposed on the inner periphery of funnel-shaped basin 204 may start step 1005. Plurality of sensors used in modern toilet is well known in the art and therefore they are not discussed in details here.

At step 1007, determining whether a user has finished using the toilet. Again, step 1007 can be realized by remote control 270 or by a plurality of sensors (not shown). At step 1006, if the user has not finished, go to step 1003 to keep the toilet open. Otherwise has finished, go to next step 1008.

At step 1008, starting to clean the user. Step 1008 can be realized by spray nozzle 209 for a first predetermined amount of time using a plurality of sensors (not shown) or remote control 270.

At step 1009, starting to dry the user. Step 1009 can be realized by extractor fan 1522 for a second predetermined amount of time using either a plurality of sensors (not shown) or remote control 270.

At step 1010, starting to clean the toilet. Step 1010 can be realized by flushing ring 2010 for a third predetermined amount of time using either a plurality of sensors (not shown) or remote control 270.

At step 1011, closing the toilet if not in use. After use, as the user closes the toilet lid 401, pair of gear axis hinges 3017 allows gear axis 2060A to rotate the opposite direction. Spur gear 2060 reciprocates by turning clockwise, lowering spur gear 2060. Connecting arm 2062 reciprocates causing rotating arm 2063 to swing inward. As a result, actuating arm 2064 rotates and hollow ball 2065 to turn its solid side upward lining up with discharge conduit 205. In this situation, portable smart toilet 100 cannot be used.

At step 1012, optionally the toilet bowl is deodorized to get rid of bad odor. Step 1012 is realized in the present invention by deodorizing/anti-bacterial material box 254, fan 2511, and extractor fan 2512. The user may use remote control 270 as described in FIG. 9 to actualize step 1005.

In step 1013, bottom tank is checked if it is filled. Step 1013 is realized by waste level monitor 108 located near the bottom of bottom tank 101.

If the bottom tank is not filled, then at step 1014, a user may start step 1001.

If the bottom tank is filled, at step 1015, disassembling a bottom tank from a top tank. A user can disassemble portable smart toilet 100 by removing bottom tank 101 from top tank 201 using first quick release locking mechanism 160 and second quick release locking mechanism 170.

Finally, at step 1016, waste materials are emptied from a bottom tank. Step 1016 is realized by using evacuation opening 104 located at the back end of bottom tank 101. More particularly, a user may use retractable pull handle 111 to drag the bottom tank 101 on first wheel 102 and second 103 to a designated area nearby to empty the content. Yet in another situation, the user may also use the top lift handle 112 to carry bottom tank 101 to such designated area. In one embodiment of the present invention, the first predetermined amount of time and second predetermined amount of time are set to 45 seconds, while the third predetermined amount of time is set to 30 seconds.

The foregoing description details certain embodiments of the invention. It will be appreciated, however, that no matter how detailed the foregoing appears in the text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

DESCRIPTION OF NUMERALS

101 bottom tank
102 first wheel
1021 first wheel recess
103 second wheel
1031 second wheel recess
106 first quick release locking mechanism
1061 first locking pin
1062 first bottom lock recess
1063 first locking plate
1064 first grasping tab
1066 first locking plate recess
107 second quick release locking mechanism
1071 second locking pin
1072 second bottom lock recess
1073 second locking plate
1074 first grasping tab
1075 second locking plate recess
108 waste level monitor
111 retractable lift handles
1111 telescopic arms
1112 telescopic arm tubes
112 front lift handles
1121 front lift handles recess
104 evacuation opening
1041 evacuation cap (lid)
105 back lifts handle
1051 back lifts recess
109 sliding valve
1090 hole
1091 rectangular cover
1092 circular opening
110 sliding valve handles
1101 connecting shaft
1102 sliding door
201 top tank
2011 toilet seat base (foundation)
301 toilet seat
401 toilet lid (cover)
250 front compartment
251 back compartment
1063 first top lock recess
1073 second top lock recess
262 water pump
2510 Back compartment lid
253 battery
260 controller
2060 spur gear
3017 spur hinge
2060A gear axis
2061 spur shaft
2062 connecting arm
2063 rotating arm
2064 actuating arm
2065 hollow ball
254 Deodorizing/anti-bacterial box
265 Deodorizing/anti-bacterial chamber lid
258 water input opening
259 water input cap
207 Deodorizing/anti-bacterial chamber
2511 deodorizing/anti-bacterial fan
2512 extractor fan
256 battery box
257 Electrical box cover
209 spray nozzle
2010 flushing ring
2021 first locking plate
2022 first tab
2023 first locking plate recess
2031 second locking plate
2032 second tab
2033 second locking plate recess
270 remote control
271 done button
272 dry button
273 spray button
274 anti (bacteria/odor) button
275 stop button
3017 gear axis hinges

What is claimed is:

1. A smart portable toilet bowl, comprising:

a bottom tank; a top tank releasably connected to said bottom tank;

a toilet seat, hingedly connected to said top tank at the back end, configured to open and close vertically at the front end of said top tank;

a toilet cover, hingedly connected to the said toilet seat at the rear end, configured to open and close vertically at the front end of said top tank, wherein said top tank further comprises a front compartment and a back compartment, said front compartment further includes a funnel-shaped basin connected to a discharge conduit at the bottom of said funnel-shaped basin, wherein said discharge conduit further having a top opening and a bottom opening;

a hollow ball valve device comprising a spherical ball having solid side and a hollow side, located underneath said lower opening of said discharge conduit, in communication with said toilet seat so that said solid side is rotated toward said top opening when said toilet cover is closed down, and wherein said hollow side is rotated toward said top opening when said toilet seat is open.

2. The smart portable toilet of claim 1 wherein said hollow ball valve device further comprises a gear shaft, an actuating arm, a rotating arm, an actuating arm connected to said spherical ball, and wherein said toilet seat and said toilet cover are in communication with said hollow ball valve device by a spur gear, wherein said spur gear is connected to said gear shaft, said actuating arm, said rotating arm, and said actuating arm.

3. The smart portable toilet bowl of claim 1 wherein said bottom tank comprises a hollow storage for containing water and waste materials, said bottom tank further comprises a back side, a front side, a left side, a right side, and a top side, wherein: said back side further comprises a first wheel and a second wheel; said top side further comprises a back lift handle and a sliding valve, wherein said, sliding valve further comprises a rectangular cover having a circular opening substantially the same size as and are substantially aligned with said lower opening of said discharge conduit; wherein said sliding vale further comprises a handle operative to open and close said rectangular cover; said left side further comprises a first quick release locking mechanism and said right side further comprises a second quick release locking mechanism for releasably connecting said bottom tank to said top tank; said top side further comprises a front lift handle and a retractable pull handle, said retractable pull handle configured to retract into said bottom tank; and said back side further comprises a waste evacuation opening with a cap located substantially at the bottom of said back side operative to release waste materials and used water from said bottom tank.

4. The smart portable toilet bowl of claim 1 wherein said back side further comprises a first wheel recess configured to contain said first wheel, a second wheel recess configured to contain said second wheel.

5. The smart portable toilet bowl of claim 1 wherein said left side further comprises a first bottom lock recess and a first locking pin, said right side further comprises a second bottom lock recess and a second locking pin.

6. The smart portable toilet of claim 1 wherein said top side further comprises a back lift recess configured to contain said back lift handle.

7. The smart portable toilet of claim 3 wherein said retractable pull has handled further comprises a pair of telescopic arms.

8. The smart portable toilet of claim 1 wherein said top tank further comprises a front side, a back side, a top side, a bottom side, a left side, and a right side, wherein said left side further comprises a first top lock recess and said right side further comprises a second top lock recess.

9. The smart portable toilet of claim 8 further comprises a first locking plate having a first tab for coupling into said first locking pin and a second locking plate having a second tab for coupling into said right locking pin.

10. The smart portable toilet of claim 1 wherein said top tank further comprises a front chamber and a back chamber, said front chamber further comprising a flushing ring having a plurality of apertures disposed around the periphery of said flushing ring for discharging water into said funnel-shaped basin.

11. The smart portable toilet of claim 9 further comprises a spray nozzle protruding from the back side of said funnel-shaped basin for cleaning a user.

12. The smart portable toilet of claim 10 further comprises a deodorizing fan and an extractor fan.

13. The smart portable toilet of claim 10 further comprises a water pump connected to said, flushing ring and said spray nozzle.

14. The smart portable toilet of claim 12 further comprises: a deodorizing chamber located on said top side of said top tank; a deodorizing device, located in said deodorizing chamber, configured to provide deodorizing and antibacteria materials to said top tank; a lid configured to cover said deodorizing chamber; and a plurality of deodorizing openings located at said back side of said second segment, wherein upon activation by a user said controller causes said deodorizing fan to introduce said deodorizing and antibacterial materials into said top tank.

15. The smart portable toilet of claim 13 wherein said top tank further comprises a water inlet located at said top side of said top tank and an evacuation cap.

16. The smart portable toilet of claim 14 further comprises: a controller electrically coupled to control said water pump, said deodorizing fan, and said extractor fan; and a plurality of sensors operative to sense when a user starts and finishes to use said smart portable toilet.

17. The smart portable toilet of claim 15 wherein said controller is coupled to said plurality of sensors to detect when a user starts to use said smart portable toilet and perform the following steps: detecting when a user starts to use said smart portable toilet, starting said deodorizing fan to introduce antibacterial and deodorizing materials into said top tank and at the same time start said extractor fan to draw out odor; when the user finishes using said toilet, activating said spray nozzle to clean user for a first predetermined amount of time; drying up the user using drying fan for a second predetermined amount of time; and cleaning said funnel-shaped basin using said, flushing ring for a third predetermined amount of time.

18. A method of using a smart portable toilet which comprises a bottom tank releasably connected to an top tank, a toilet seat, a cover connected to a hollow ball valve device, a flushing ring, a spray nozzle, an extractor fan, and a deodorizing fan, comprising: opening said toilet seat for use; rotating said hollow ball valve device to open a discharge conduit located in said top tank; beginning to use said toilet; start deodorizing fan to introduce antibacterial and deodorizing materials into said top tank and at the same time start said extractor fan to extract odor from said top tank; when the user finishes using said toilet, activating the spray nozzle to clean user for a first predetermined amount of time; drying up the user using drying fan for a second predetermined amount of time; cleaning said toilet bowl, using flushing ring for a third predetermined amount of time; and upon closing said cover, rotate said hollow ball valve device to close up said discharge conduit.

19. The method of claim 18 further comprising: examining whether said bottom tank is filled up, if said bottom tank is filled up, disassemble said bottom tank from said top tank by using a pair of latching mechanism, and bringing said bottom tank to a known toilet location, open an evacuation cap and empty the content of said bottom tank.

20. The method of claim 18 further comprising determining whether said top tank has sufficient water to use, if said top tank does not have sufficient water, refilling the water for said top tank before use.

* * * * *